US006031442A

United States Patent [19]

Nakazawa

[11] Patent Number: 6,031,442

[45] Date of Patent: Feb. 29, 2000

[54] ELECTRONIC COMPONENT

[75] Inventor: Michiya Nakazawa, Tsurugashima, Japan

[73] Assignee: Toko Kabushiki Kaisha, Tokyo, Japan

[21] Appl. No.: 09/156,606

[22] Filed: Sep. 18, 1998

[30] Foreign Application Priority Data

Sep. 19, 1997 [JP] Japan ..... 9-273912

[51] Int. Cl.[7] ..... H01F 27/02; H01F 27/28

[52] U.S. Cl. ..... 336/96; 336/192; 336/229; 336/90

[58] Field of Search ..... 336/90, 96, 192, 336/229

[56] References Cited

U.S. PATENT DOCUMENTS 4,275,368 6/1981 Wimmer ..... 333/167
4,543,554 9/1985 Muellenheim et al. ..... 336/83
4,939,494 7/1990 Masuda et al. ..... 336/96
5,034,854 7/1991 Matsumura et al. ..... 336/96

FOREIGN PATENT DOCUMENTS 828738 2/1960 United Kingdom ..... 336/96

*Primary Examiner*—Michael L. Gellner
*Assistant Examiner*—Anh Mai
*Attorney, Agent, or Firm*—Pillsbury Madison & Sutro, LLP

[57] ABSTRACT

An electronic component such as a transformer or choke coil in which a coil is wound around the toroidal core to form a coil element which is completely encased in resin case. The inside of the case is partitioned by a plate so that the external terminals are fixed within terminal housing sections formed in four corners of the case and the toroidal core is fixed within a core housing section formed at the center of the case.

8 Claims, 2 Drawing Sheets

ELECTRONIC COMPONENT

BACKGROUND OF THE INVENTION

1. Field of the Invention

This invention relates to electronic components such as transformers, choke coils etc. in which the coil element formed by winding the coil around a toroidal core is entirely encased in a resin case.

2. Prior Art

FIG. 7 is a bottom view of a conventional electronic component and FIG. 8 is a cross sectional view of FIG. 7.

In conventional electronic components, the coil 73 is wound around a toroidal core 72 and the leads of the coil 73 are connected to terminals 74, thereby, forming a coil element 71. This coil element 71 is wrapped in a resilient (elastic) protective material 78 such as silicon resin and is then housed in a resin case. Resin such as epoxy 79 is then injected into the case 75, thereby completely sealing the component. The toroidal core 72 and the external terminals 74 are fixed to the case 75 by this resin 79.

In such electronic components, the pressure at the time of injecting the resin 79 into case 75 and the pressure caused by contraction when the resin 79 solidifies is absorbed by the resilient protective material 78, thereby preventing degradation of the characteristics of the coil element 71. However, in the case of such conventional electronic component, it has been difficult to produce resilient (elastic) protective material 78 and resin 79 with equal thermal heat expansion coefficients. In general, the thermal expansion coefficient for the resilient protective material 78 is greater than that for the resin 79. Moreover, air bubbles sometimes enter the resilient protective material 78 when the coil element 71 is wrapped and remain after the resilient protective material 78 has solidified. Accordingly, in conventional electronic parts, bubbles within the resilient protective material 78 or the resilient protective material 78 itself become swollen by heat from solder when the external terminal 74 is soldered to the printed board of the electronic device so that the resin 79 or the case 75 swells to result in cracks in the resin 79 or the case 75. When the electronic component is thin, the thickness of the resin 79 sealing the resilient protective material 78 is also thin, and the space between the resin 79 and the connecting surface of the external terminal 74 is narrow. In such components, the swollen resilient protective material 78 can break the resin 79, and can be projected out from the connecting surface of the external terminal 74.

SUMMARY OF THE INVENTION

An object of this invention is to provide electronic components for which there is no possibility of the characteristics of the coil element being degraded by the pressure of resin and for which there is no possibility of the case becoming swollen or cracking.

To achieve the above-mentioned object, in accordance with this invention, there is provided an electronic component comprising a toroidal core on which a coil is wound, an external terminal to which the winding is connected, and a case within which the toroidal core and the external terminal are housed, wherein the case is partitioned on the inside by a plate so that a terminal housing section and a core housing section are respectively formed, and wherein the external terminal is fixed to the inside of the terminal housing section and the toroidal core is fixed to the inside of the core housing section.

In the electronic component of this invention, the inside of the case is partitioned by a plate so that terminal housing section are formed at the four corners of the case and the core housing section is formed at the central portion of the case. Furthermore, the toroidal core on which the coil is wound is fixed within the core housing section of the case and the external terminal connected to the leads of the coil is fixed to the inside of the terminal housing section and the inside of the case is not sealed by epoxy resin as is done conventionally.

DESCRIPTION OF THE PREFERRED EMBODIMENTS

The preferred embodiments of an electronic component of this invention will now be described with reference to FIGS. 1 to 6.

Figure 1:
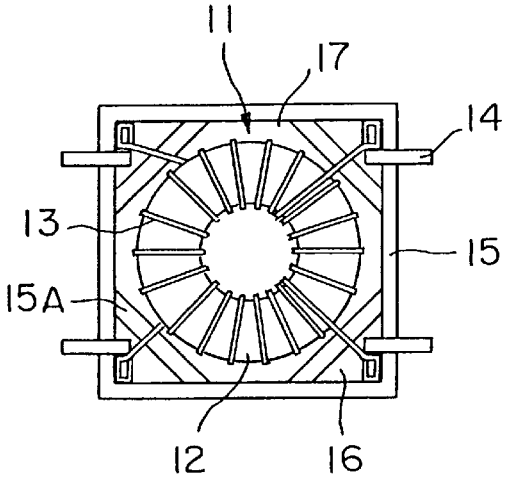
FIG. 1 is a bottom view of a first embodiment of an electronic component of this invention.
Figure 2:
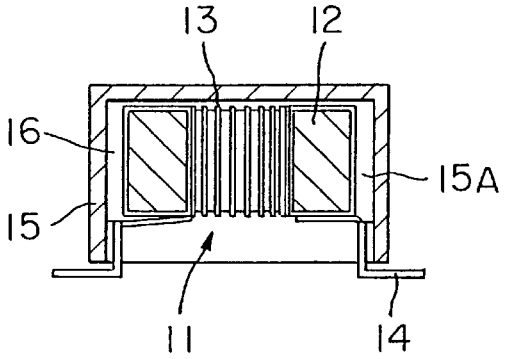
FIG. 2 is a cross sectional view of FIG. 1.

FIG. 1 is a bottom view of the first embodiment of the electronic component according to this invention, and FIG. 2 is a cross sectional view of FIG. 1.

In FIGS. 1 and 2, reference numeral 11 denotes a coil element, reference numeral 12 denotes a toroidal core, reference numeral 13 denotes a coil, reference numeral 14 denotes an external terminal, and reference numeral 15 denotes a case.

The coil element 11 is formed by winding the coil 13 on the toroidal core 12. Leads of the coil 13 are connected to the lead tie-up (binding) portion provided at one end of the external terminal 14. The coil element 11 is housed within the case 15 of resin.

The inside of the case 15 is partitioned by a plate 15A built into the case, wherein terminal housing sections 16 are formed at each of the four corners. A core housing section 17 is formed at the center of the case 15. The terminal housing sections 16 are adapted so that one end of the external terminals 14 is respectively inserted from the open side of the case 15, and the external terminals 14 are bonded to the case 15 by an epoxy-based adhesive. The core housing section 17 is adapted so that the toroidal core 12 on which the coil 13 is wound is inserted from the open side of the case 15, and the toroidal core 12 is bonded to the case 15 by a silicon-based adhesive.

This electronic component is used with the open side of the case 15 facing downward, and the other ends of the external terminals 14 drawn out from the open side are connected to printed circuit of electronic device.

Figure 3:
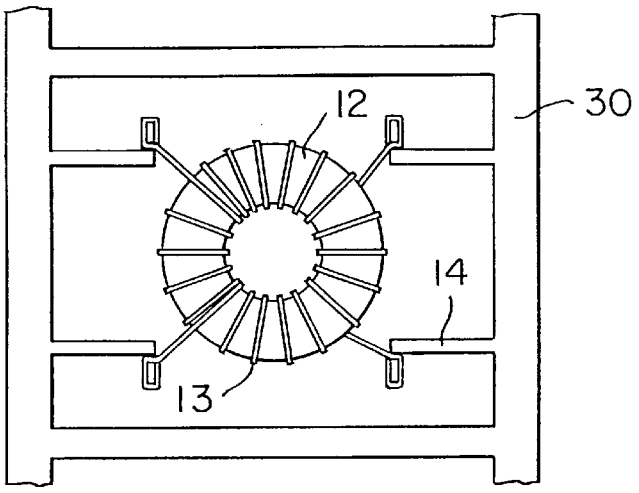
FIG. 3 is a top view showing the production of an electronic component of this invention.
Figure 4:
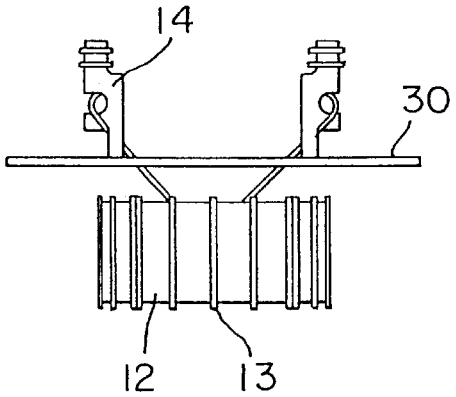
FIG. 4 is a side view of FIG. 3.

Such an electronic component is manufactured by the method described below. First, a metal plate is punched so that plural external terminals 14 are formed integrally within the frame, thereby forming a lead frame 30 in which the lead tie-up portion provided at one end of the external terminal 14 is bent. Then, the leads of the coil 13 wound around the toroidal core 12 are tied onto the lead tie-up portion at one end of the external terminal 14 as shown in FIGS. 3 and 4, and the leads of the coil 13 are soldered to the external terminals 14. Next, the toroidal core 12 on which the coil 13 is wound and the external terminals 14 to which the leads of the coil 13 are connected are placed within the case 15 in the manner previously described. After being fixed by an adhesive agent, the external terminals 14 are cut from the lead frame 30.

Figure 5:
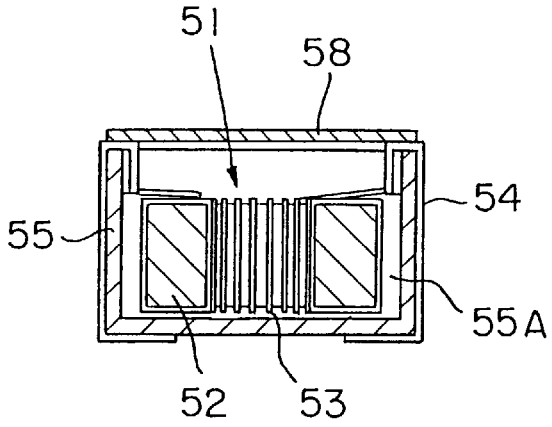
FIG. 5 is a cross sectional view of a second embodiment of an electronic component of this invention.

FIG. 5 is a cross sectional view of the second embodiment of an electronic component according to this invention.

In FIG. 5, reference numeral 51 denotes a coil element, reference numeral 52 denotes a toroidal core, reference numeral 53 denotes a coil, reference numeral 54 denotes an external terminal, reference numeral 55 denotes a case, and reference numeral 55A denotes a partitioning plate within the case.

The coil element 51 formed by winding the coil 53 around the toroidal core 52 has the leads of the coil 53 connected to the external terminals 54, and is housed within a case 55 of resin. The inside of the case 55 is partitioned by the plate 55A, wherein terminal housing sections are formed at the four corners of the case and a core housing section is formed at the center of the case. Next, the toroidal core 52 on which the coil 53 is wound is secured within the core housing section by an adhesive and one ends of the external terminal ends 54 is secured within the terminal housing section by an adhesive agent The other ends of the external terminals 54 are drawn out from the open side of the case 55, and are bent to run along the side of the case 55. The case 55 is then adapted so that the open side is covered by a lid 58 of a dimension sufficient to cover the opening.

Figure 6:
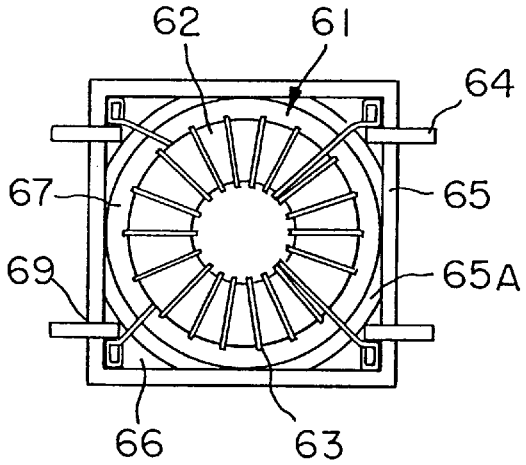
FIG. 6 is a bottom view of a third embodiment of an electronic component of this invention.
Figure 7:
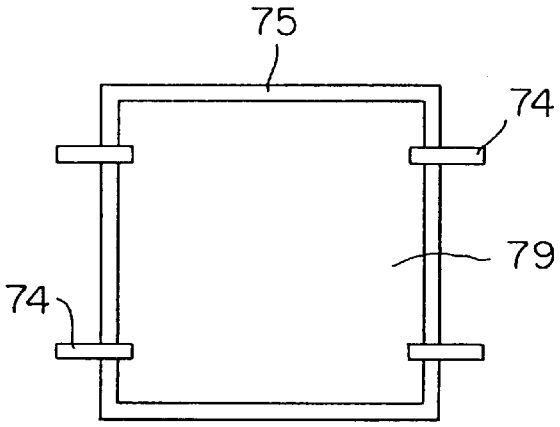
FIG. 7 is a bottom view of a conventional electronic component.
Figure 8:
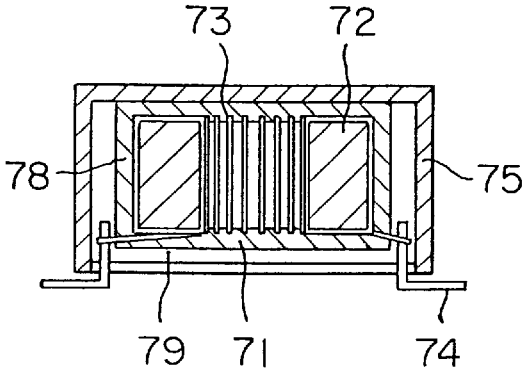
FIG. 8 is a cross sectional view of FIG. 7.

FIG. 6 is a bottom view of the third embodiment of an electronic component according to this invention.

A coil element 61 is adapted so that leads of the coil 63 wound around the toroidal core 62 are connected to the external terminals 64, and are housed within the case 65 of resin. The case 65 is adapted so that a core housing section 67 and four terminal housing sections 66 are formed by a partitioning plate 65A, and grooves 69 for determining the positioning of the external terminals are provided at positions where the external terminals extend at the opening end. The toroidal core 62 is secured within the core housing section 67 and the ends of the external terminals 64 are secured within the terminal housing sections 66.

While the preferred embodiments of the electronic components of this invention have been described above, this invention is not limited to these embodiments. For example, the external terminal may be a pin type terminal. The position or the number of the grooves for carrying out positioning of external terminals can be changed in accordance with the position or the number of external terminals.

In this invention, the inside of the case for the electronic component is partitioned by a plate thereby forming the terminal housing section within which the terminals are fixed and the core housing section within which the toroidal core is fixed. Thus, the external terminals and the toroidal core can be fixed to the case by different types of adhesive. Accordingly, degradation of the characteristic of the electronic component due to pressure of the resin and swelling or cracking of the case can be eliminated.

In addition, the toroidal core of the coil of the electronic component of this invention is not covered by epoxy resin as in the prior art, which means the work for wrapping the toroidal core on which the coil is wound in a resilient protective material or removing the air trapped within the resin becomes unnecessary.

What is claimed is:

1. An electronic component, comprising;

a toroidal core on which a coil is wound;

external terminals to which the coil is connected; and a case within which the toroidal core and the external terminals are housed, wherein said case is partitioned by plates so as to define four corners of said case to form a terminal housing section and a core housing at each corner section, said external terminals being fixed to said terminal housing section at the four corners of said case, and said toroidal core being fixed to said core housing section, respectively.

2. An electronic component as set forth in claim 1, wherein said external terminals are fixed in said terminal housing section in said case and said toroidal core is fixed in said core housing section by using different adhesives, respectively.

3. An electronic component as set forth in claim 1, wherein said external terminals are fixed to said terminal housing section in said case by an epoxy-based adhesive, and said toroidal core is fixed to said core housing section in said case by a silicone-based adhesive.

4. An electronic component as set forth in claim 1, wherein said case has a cover attached on the open side of said case.

5. An electronic component comprising a toroidal core on which coil is wound, external terminals to which the coil is connected, and a case within which the toroidal core and the external terminal are housed, wherein the inside of the case is partitioned by plates so that terminal housing sections are formed at the four corners of the case and a core housing section is formed in the center of the case, and the external terminals are fixed within the terminal housing sections and the toroidal core is fixed within the core housing section.

6. An electronic component as set forth in claim 5, wherein the external terminals are fixed within the terminal housing sections of the case by one type of adhesive and the toroidal core is fixed within the core housing section of the case another type of adhesive.

7. An electronic component as set forth in claim 5, wherein the external terminals are fixed within the terminal housing sections of the case by an epoxy-based adhesive, and the toroidal core is fixed within the core housing section of the case by a silicon-based adhesive.

8. An electronic component as set forth in claim 5, wherein the case has a cover attached on the open side of the case.

* * * * *